United States Patent [19]

Zakiewicz

[11] Patent Number: 4,550,779

[45] Date of Patent: Nov. 5, 1985

[54] PROCESS FOR THE RECOVERY OF HYDROCARBONS FOR MINERAL OIL DEPOSITS

[76] Inventor: Bohdan M. Zakiewicz, 4521 E. 75th, Tulsa, Okla. 74136

[21] Appl. No.: 586,714

[22] Filed: Mar. 6, 1984

[30] Foreign Application Priority Data

Sep. 8, 1983 [GB] United Kingdom ..... 8306307

[51] Int. Cl.[4] ..... E21B 43/24; E21B 43/267

[52] U.S. Cl. ..... 166/248; 166/249; 166/266; 166/272; 166/280; 166/306

[58] Field of Search ..... 166/248, 249, 266, 271, 166/272, 280, 306

[56] References Cited

U.S. PATENT DOCUMENTS

| | | | |
|---|---|---|---|
| 1,107,416 | 8/1914 | Dunn | 166/272 X |
| 2,796,129 | 6/1957 | Brandon | 166/249 |
| 2,862,556 | 12/1958 | Tek | 166/271 |
| 3,118,499 | 1/1964 | Johnson et al. | 166/271 |
| 3,120,263 | 2/1964 | Hoyt | 166/306 X |
| 3,333,637 | 8/1967 | Prats | 166/306 X |
| 3,547,193 | 12/1970 | Gill | 166/248 |
| 3,620,300 | 11/1971 | Crowson | 166/248 |
| 3,709,295 | 1/1973 | Braunlich, Jr. et al. | 166/271 X |
| 3,881,550 | 5/1975 | Barry | 166/272 |
| 4,064,942 | 12/1977 | Prats | 166/303 |
| 4,109,722 | 8/1978 | Widmyer et al. | 166/306 X |
| 4,265,310 | 5/1981 | Britton et al. | 166/271 X |
| 4,305,463 | 12/1981 | Zakiewicz | 166/249 X |
| 4,362,213 | 12/1982 | Tabor | 166/306 X |
| 4,407,367 | 10/1983 | Kydd | 166/306 X |
| 4,418,752 | 12/1983 | Boyer et al. | 166/266 X |

FOREIGN PATENT DOCUMENTS

| | | | |
|---|---|---|---|
| 1112596 | 5/1968 | United Kingdom | 166/272 |

*Primary Examiner*—George A. Suchfield
*Attorney, Agent, or Firm*—Hall, Myers & Rose

[57] ABSTRACT

A process is provided for the recovery of hydrocarbons, and especially heavy hydrocarbons, from oil-bearing strata, wherein mining liquids are injected at a bottom level and removed at an upper collecting level together with displaced liquid hydrocarbons, and the mining liquids are separated from the product hydrocarbons at the well-head and re-injected. The mining liquids may consist, in part, of an unrefined fraction from product cracking or semi-refining carried out in the vicinity of the well head, together with inorganic solvents, and are injected under pulsating pressure at a temperature not exceeding 100° C. The strata can be deliberately fractured horizontally at the injection and collecting levels to promote desirable flow patterns, the fractures being propped open by means of a particulate filling medium. Hot gas under pressure can be injected at the boundaries of the working zone to create barriers to flow by the melting and re-solidifying of heavy hydrocarbons. If the particulate filling medium in the fractures is electrically conductive, a beneficial electrokinetic effect can be achieved by providing electrodes in contact therewith in the well bore.

22 Claims, 2 Drawing Figures

PROCESS FOR THE RECOVERY OF HYDROCARBONS FOR MINERAL OIL DEPOSITS

Figure 1:
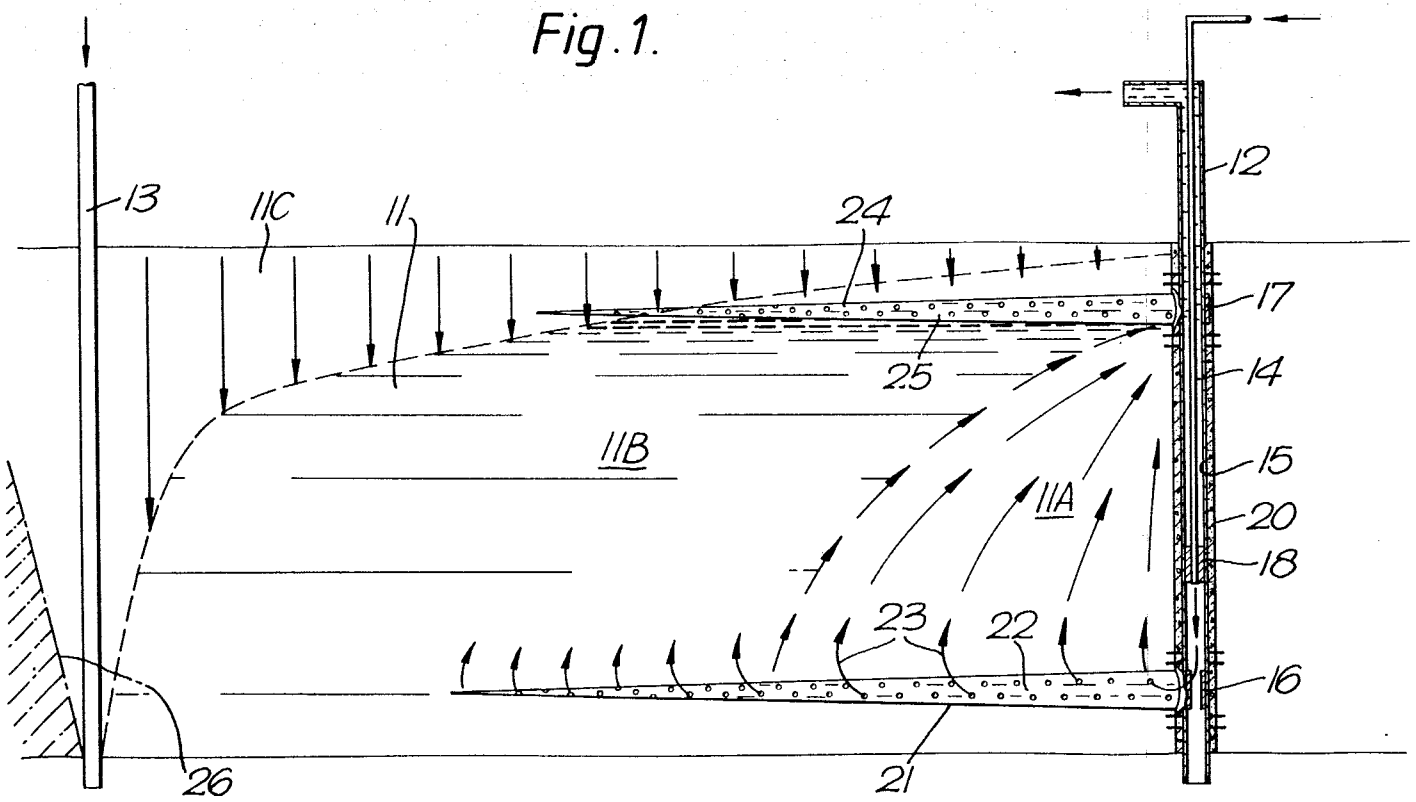

This invention relates to the recovery of hydrocarbons from mineral oil deposits. With the traditional methods of extraction and recovery of mineral oils from oil wells, most of the valuable hydrocarbon deposit is irrecoverable. In the case of the fraction consisting of the heavy oils and tars usually only up to about 5% of the deposit is flowable and the remainder stays in the ground. It is also not possible to extract and raise considerable amounts of light oil held in oil-wet rock formations because the oil is not sufficiently mobile due to the effects of capillarity and surface tension. The result is that from the time a virgin well goes into production to the time when it is closed off as dead, commonly only about 25–30% of the actual hydrocarbon deposit in the ground is raised. Moreover, during the productive life of a well the recovery and raising of the hydrocarbon product becomes increasingly more difficult and less economic as the reserve of readily flowable oil in the ground decreases.

In the prior art, several processes for increasing total well yield have been tried with generally poor results. Solvents for hydrocarbons have been injected to dissolve the hydrocarbon deposits but this technique has proved uneconomical. Steam injection has also been tried, to melt solid deposits, but results have been disappointing because the steam only attacks a thin layer of the oil-bearing strata and even if the oil is melted it tends to refreeze before it can be raised and thereby create an impermeable layer.

It is therefore an object of the present invention to provide a process whereby hitherto economically irrecoverable hydrocarbon oil deposits can be successfully mined.

According to the method of the present invention, mining liquids under pressure are injected into the oil-bearing strata to displace and render flowable the hydrocarbon deposits, in a continuous hydrodynamic recycling operation whereby the mixture of mining liquids and recovered liquid hydrocarbons arriving at the surface is processed in the vicinity of the well-head to separate product and regenerate the mining liquids for re-injection. Both substantially solid non-flowable deposits and lighter flowable oils trapped in porous rock formations may be continuously displaced upwards by injecting the mining liquids at the bottom of the oil bearing strata and withdrawing liquids for return to the surface at an upper collecting level. The deposits can be set flowing and kept flowing by a combination of the actions by the mining liquids in liquefying, dissolving, diluting and displacing the hydrocarbons, and by the application through the mining liquids of controlled hydrodynamic pulsations. For the latter purpose, a comparatively low speed high volume reciprocating piston pump or similar device can be employed, care being taken to ensure that the peak pressures applied are below the pressure at which fracturing of the formation will occur and set up undesirable channelling.

However, high temperatures are not employed. It is desirable to keep the temperature of the mining liquids below 100° C. in order to prevent gasification and dispersal into the upper layers and consequent loss of otherwise recoverable product and mining liquids. At the same time, it is important to avoid re-solidification of heavy oils because this blocks the interstices of the formation.

An important concept is the cracking or semi-refining of the mixture of product and mining liquids at the well-head. This provides a light fraction for re-cycling to the well as mining liquid. However, a highly refined expensive light oil fraction is not needed for this purpose—a cheap unrefined cracking product is entirely adequate. The well-head plant can therefore be comparatively unsophisticated and inexpensive, leaving the sophisticated refining to be accomplished in a subsequent stage.

As already discussed, the mining liquids are injected at or near the bottom of the oil bearing formation and the mixture of product and mining liquids is collected at or near the top. To promote the circulation, the bore can be blocked off internally at a level in between, by means of an appropriate body of packing material. This forces the mining liquids to flow out into the surrounding formation and since under usual geological conditions the permeability of the formation is many times greater in the horizontal direction than in the vertical direction, the liquids tend to flow in a wide sweep first outward way from the bore and then upward and inward to the collection point, with deeper and deeper horizontal penetration occurring as the hydrocarbon deposits are flushed out.

The natural geological permeability of the formation can, if desired, be supplemented by deliberate horizontal fracturing. If fracturing pressure is developed simultaneously at the same level in the formation in, say, a group of three to five adjacent wells the formation will normally fracture horizontally at that level. This technique can provide favourable conditions for the flow of the mining liquids horizontally prior to their subsequent permeation into the upper zones to sweep out the hydrocarbons contained therein.

A fracture can be initiated by 'notching' the formation at the same level in each bore by means of explosive charges, after which fracturing is propagated hydraulically by forcing in under pressure a flowable slurry of an appropriate particulate filling medium. Simultaneous pressure at all of the initiating notches will develop a horizontal fracture in the formation, in manner analogous to the splitting of stone by first forming notches or cuts at different locations in the plane of the split and then applying the splitting force equally at all locations. As the stratified fracture develops, the particulate medium fills the widening crack, and eventually the whole zone around and amongst the wells has a continuous underlying roughly horizontal fracture propped open by a filling layer of particulate medium which is readily permeable to liquid flow.

Considering again the mining liquids, these may also comprise water-based solvent solutions, e.g. inorganic solvents, which function to improve the mobility of the oil. The injected solutions will mix with mine water with no adverse effect, to shrink and eventually fluidise clayey sediments in the formation. Such water-based solutions can be injected consecutively or blended with organic solvents and diluents preferably originating at the well-head as a light fraction produced from the recovered heavy hydrocarbons, as already described. The organic liquids, injected into the formation at a moderately elevated temperature, serve to solubilise non-flowable hydrocarbons and carry them out of the formation to the collecting point. A variety of mobilisers, surfactants, emulsifiers, and so forth, can be included in the mining liquids, so long as they are able to withstand the temperature and environment.

The aim is to recover or regenerate, reheat and reinject as much as possible of the mining liquids, with as little loss as possible. At start-up, it is necessary to provide an initial supply of liquids but when the process is running the mining liquids will be obtained by separation and generation from the hydrocarbon mix arriving at the well-head, except for make-up necessary to replace losses in the formation. During operation, the quantity of mining liquids required will increase to maintain the operating pressure as greater and greater penetration of the formation is achieved but the additional supply can mostly be generated by cracking of the recovered hydrocarbons as already discussed. However, in order to minimise formation losses, a technique of barriering can be employed as will now be described.

To create barriers at the boundaries of the working zone where the process is to be carried out, hot gas is injected at locations at the periphery of the zone. The dynamic flows of gas entering the formation from barriering bore-holes sunk at the periphery permeate through the formation and melt semi-solid or substantially solid heavy hydrocarbons which flow into the pores and interstices of the formation and progressively block them upon cooling down and refreezing. In this way, the outlying areas of the zone to be processed become increasingly more efficient at restricting and localising the gas flow, and impermeable barriers are created to prevent escape of mining liquids and product from the working zone. The working zone thus becomes isolated from the surrounding field by a peripheral barrier created by the heavy hydrocarbons themselves. In this instance, it is not necessary to inject the hot gases solely at the bottom of the hydrocarbon-bearing deposit—the upper layers of the formation also can be injected and heavy hydrocarbons thus rendered flowable will tend to sink down under the action of the gas pressure and impregnate the underlying layers.

The pressure of the hot injected gases is selected to suit the hydraulic pressure of the mining liquids in the working zone, the gas pressure being higher than the liquid pressure. The gases used can be a mixture of gases available from the well-head separation and cracking plant, which after treating the mixture of product hydrocarbons, mining liquids and gas arriving from the production bores delivers separated streams of product, regenerated mining liquids and hot gases. A major quantity of gas from this hot gas stream can be mixed with minor quantities of gas/oil combustion gases from the flue stacks of the boilers and from conversion/-reforming plant units to provide the barrier-forming injection gases. In this way, the emission of pollutant gases into the atmosphere can be avoided, and all waste heat contained in stack gases is recovered.

A further advantage of the barrier-forming gas injection is that the gases, rising toward the upper levels of the formation, migrate from the places of injection at the barriering bore-holes to the production bores through the upper layers and thereby create a pressurised 'gas cap' which co-operates with the mining liquids rising under pressure from the bottom layers to 'squeeze' the hydrocarbons in the intervening layers out of the formation and transport them to the production bores. Stratified fracturing of the hydrocarbon-bearing formation at or near the bottom level has already been discussed; and the formation can be similarly fractured in a substantially horizontal plane at or near the top level, the crack being again propped open by the introduction of a permeable layer of a particulate filling medium. This provides a channel through which the pressurised gases can readily flow toward the production bores, sweeping the liquid hydrocarbons along as they percolate into the channel.

Figure 2:
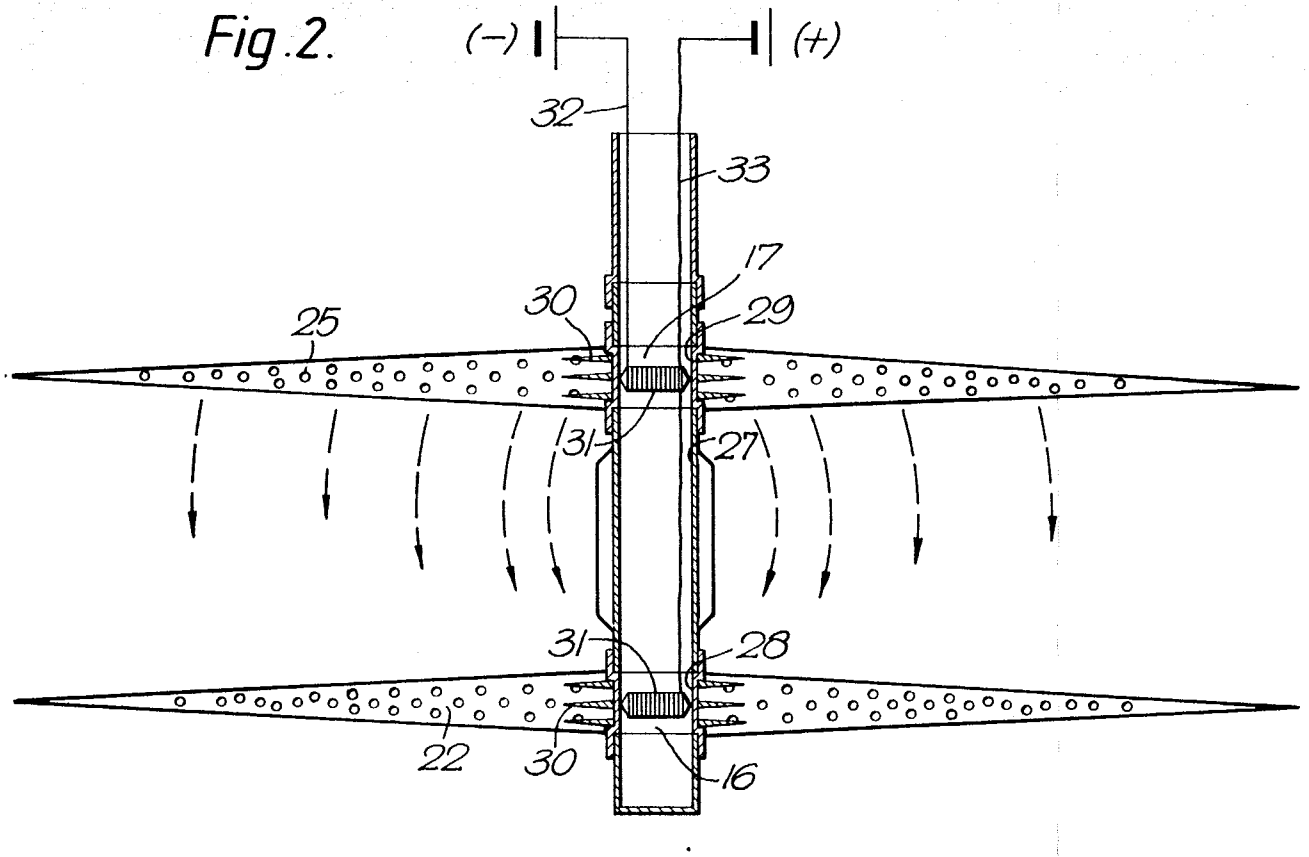

Techniques according to the invention will now be further described by way of example and with reference to the accompanying diagrammatic drawings, in which:

FIG. 1 is a diagram illustrating the recovery of heavy hydrocarbon deposits from oil-bearing rock formations, and FIG. 2 illustrates a modification of the bore-holes to obtain an electrokinesis effect.

FIG. 1 shows a section of a hydrocarbon-bearing rock formation 11, into which have been sunk a production bore 12 and a barriering bore 13. The bore 13 has a single casing for downward flow under pressure of the gas to be injected. The production bore 12 has inner and outer concentric casings, the inner casing 14 being employed for downward flow of mining liquids under pressure, while the annular space between the inner casing and the outer casing 15 is employed for upward flow of mixed product, mining liquids and gas. The mining liquids are injected via low speed, high volume reciprocating pump into the hydrocarbon-bearing formation at a location 16 near the bottom level of the formation, while the collecting point 17 for the mixture returning to the surface is located near the top level. At a level between the injection and collecting points 16, 17 the bore hole 12 is blocked off by a packer body 18 except for a bore in the packer body through which pass the mining liquids descending through the inner casing 14. The lower end of the inner casing 14 terminates in the bore in the packer body. The outer casing 15 is itself encased in cement 20.

To promote outward flow of the mining liquids from the bore hole 12 at the location 16, a stratified fracture 21 of the hydrocarbonbearing formation 11 is produced horizontally at that level. For this purpose, an explosive ring is placed around the bore hole at the location 16 and detonated to cause an initial crack or notch, the explosive ring being of a known directional type such that the explosive force is directed outwardly, and then the initiating crack or notch is developed to form a fracture 21 by the hydrodynamic pressure of an appropriate filling medium pumped down through the inner casing 14, the filling medium flowing into the fracture and propping it open as the fracture develops, as already described. Since the filling medium is a particulate material permeable to gases and liquids, when the fracture 21 has been developed the result is that there is created a narrow horizontal wedge 22 of the permeable filling medium underlying the hydrocarbon-bearing formation and through which the mining liquids can subsequently readily flow outward from the injection location 16. The outer casing 15 of the bore hole is, of course, interrupted or made permeable at this location to permit such outward flow. In this way, the mining liquids permeate the layer 22 and are thence forced upward into the hydrocarbonbearing formation, as indicated by the arrows 23, under the influence of the hydrodynamic pulsating pressure applied to the mining liquids.

In precisely similar fashion, a stratified fracture 24, propped open with permeable filling medium 25, is developed horizontally at the upper level of the collecting point 17, so that the upper permeable layer 25 is in fluid communication with the uptake annular space in the bore hole 12 between the inner and outer casings 14, 15. As a consequence, the mining liquids forced into the formation 11 at the lower fracture 21 percolate up through the formation in order to reach the upper fracture 24 and the upper collecting point 17 and so escape back to the surface by way of the annular uptake in the bore hole. In so doing, they progressively solubilise and render flowable the heavy hydrocarbons in the formation 11, which hydrocarbons then also flow to the surface as product mixed with the returning mining liquids. The process of extracting these heavy hydrocarbons starts in the zone adjacent the bore hole 12 and progressively travels outward to the extremity of the fracture 21 as greater and greater penetration of the formation 11 is achieved. The diagram of FIG. 1 illustrates an intermediate stage in the process in which the zone 11A closer to the bore hole 12 has been fully penetrated and stripped of hydrocarbons to a substantial extent, while the outer zone 11B remains to be penetrated.

The hot gas under pressure passed down the bore hole 13 is allowed to permeate into the formation around the bore hole and, by the process of melting and refreezing of the heavy hydrocarbons already discussed, an impermeable barrier 26 of hydrocarbon-impregnated rock is built up on the side of the bore hole 13 opposite to the production bore hole 12. The gas infiltrates the upper layers of the formation 11, travelling toward the collection joint 17 of the bore hole 12, and the presence of the gas under pressure in the upper zone 11C of the formation forms a 'gas cap' between which and the mining liquids the hydrocarbons that are being solubilised and rendered flowable in the zone 11B are 'squeezed' toward the collection point 17. As already discussed, the mining liquids are subjected to a pulsating pressure; the appropriate pressure range in a particular case will vary according to the type of rock formation and the depth, and can be determined by laboratory tests on rock samples. The hydrodynamic pressure should not, as already stated, be so high as to crack the rock. Because of the pressures set up in the formation, the mixture of hydrocarbon product and mining liquids flows up to the surface without additional pumping.

Although in FIG. 1 the stratified fractures 21 and 24 are shown extending from a single bore hole 12, fracturing pressure is actually applied simultaneously at a group of 3 to 5 boreholes as already discussed. These boreholes should not be spaced more than 30 to 35 meters apart. Preferably, the filling medium that is hydraulically forced into the fractures is comprised of metal particles or metallised sand grains so as to be electrically conductive. This enables the layers of filling medium 22, 25 to be employed as oppositely-poled electrodes to induce an electrokinetic effect in the formation. If the upper layer 25 is connected as a negative electrode and the lower layer 22 as a positive electrode, the resulting electrokinetic effect promotes flow of liquids upward and migration of electrically-charged clay micelles in the opposite direction by electrophoresis. This progressively removes clayey deposits from the upper part of the formation and the passages leading to the collection point and improves the permeability and productivity of the formation. With the oppositely-poled electrode layers producing hydrocarbon and hydrogen gases, conversion of the oil begins underground.

FIG. 2 shows the in-fill layers 22, 25 constituted as electrodes. The lower part 27 of the borehole casing is constructed of non-conductive material, such as glass-reinforced synthetic resin, with electrically-conductive metal sleeves 28, 29 inserted at the locations 16 and 17. Externally, the sleeves 28, 29 are provided with fins 30 which extend into the layers 22, 25 to give good electrical connection. To allow flow of fluids out of and into the borehole at the locations 16, 17, the sleeves 28, 29 are either perforated before installation or perforated in situ with directional explosives. Internally, the sleeves 28, 29 are contacted by respective ring electrodes 31 that are each resiliently expanded by a spring mechanism into tight engagement with the sleeves. The spring pressure can be relieved to free the rings 31 and enable them to be moved vertically in the borehole, especially for retrieval and replacement. Each of the rings 31 is connected to a respective electrical conductor 32, 33 extending to the surface. To prevent short circuiting by liquids collecting against the outside of the non-metallic casing 27, an expandible packing material is placed around the section of the casing between the sleeves 28, 29 to fill any gap between the casing and the surrounding rock formation.

At the well head, a heavy oil conversion unit, either stationary or mobile, is provided to crack the heavy hydrocarbon content of the mix rising at the production bores and produce a partially refined light oil fraction. This can be pumped to store, a proportion being taken off for return as mining liquid, after mixing with other mining liquids that have been separated in an oil-gas-polymer mix heater/separator unit. A hot gas stream from the heater/separator is supplied to the barriering bores around the periphery of the mining zone. If electrokinetic effect is employed, there will be a transformer/rectifier to provide a d.c. supply to the wells. The units required are comparatively inexpensive, and since the recycling system is conducted with optimum heat and energy conservation and low energy input, and the product is already partially refined, a process is achieved that can mine previously uneconomic hydrocarbon deposits at a cost that is competitive even considering the low oil prices at present prevailing. It is aimed to achieve a hydrocarbon deposit recovery of 60–70%.

Variations in the process described are, of course, possible without departing from the scope of the invention. Thus, if the formation is not suited to barriering by gas injection, an alternative barriering technique can be employed, such as by creating vertical fissures with the use of explosives and filling with a stabilised clayey suspension.

I claim:

1. A process for recovery of hydrocarbons from mineral oil deposits, comprising the steps of:

(a) establishing fluid communication between a subterranean oil bearing strata and a processing facility on the overlying surface;

(b) injecting mining liquids at an injection level into the strata to displace and render flowable hydrocarbon deposits contained therein, the liquids being at a temperature not substantially in excess of 100° C. and being injected in hydrodynamic pulsations at a pressure greater than the ambient pressure of the strata, but insufficient to induce fracturing and undesirable channelling differential within the formation;

(c) collecting the mixture of mining liquids and flowable hydrocarbons at a collecting level and bringing the mixture to the processing facility; and (d) hydrodynamically recycling the mining liquids.

2. A process according to claim 1, wherein the liquids are injected under pressure substantially at the bottom of the oil-bearing strata thereby establishing a lower injecting level and the mining liquids form a mixture with flowable hydrocarbons which together are displaced upwards within the strata to an upper collecting level where the mixture is withdrawn from the strata for return to the surface.

3. A process according to claim 2, wherein controlled hydrodynamic pulsations are applied to the mining liquids, the peak pressures being below the pressure at which fracturing of the formation will occur.

4. A process according to claim 3, wherein the pulsations are applied by a comparatively low speed high volume reciprocating piston pump.

5. A process according to claim 2, wherein between the injection and the collecting levels the bore through which the mining liquids are injected and recovered is blocked off from the oil-bearing strata by packing material so that the liquids are forced to flow out into the surrounding formation before returning to the bore at the collecting level.

6. A process according to claim 1 wherein the natural geological permeability of the formation is supplemented by deliberate horizontal fracturing at the injection level prior to injection of the mining liquids.

7. A process according to claim 6, wherein deliberate horizontal fracturing is effected also at the collecting level prior to injection of the mining liquids.

8. A process according to claim 7, wherein the horizontal fracturing is promoted by developing fracturing pressure simultaneously at the same levels in the formation in a group of three to five adjacent wells.

9. A process according to claim 8, wherein the horizontal fracturing is initiated by notching the formation at the same level in each well bore by means of explosive charges.

10. A process according to claim 8, wherein the horizontal fracturing is propagated hydraulically by forcing in under pressure a flowable slurry of a particulate filling medium to fill and prop open the widening crack and thereby create in the fracture a layer that is readily permeable to liquid flow.

11. A process according to claim 10 wherein the particulate filling medium is electrically conductive, and the well bore is provided with electrodes of opposite polarity at the injection and collecting levels, respectively, in contact with the particulate filling medium in the fractures at those levels, and further including the step of passing electrical current between the fractures.

12. A process according to claim 1, wherein the mining liquids are heated to a temperature not in excess of 100° C.

13. A process according to claim 1, wherein the mining liquids comprise, at least in part, an unrefined cracking product obtained by cracking or semi-refining the mixture of product and mining liquids at the well head.

14. A process according to claim 13, wherein the mining liquids include inorganic solvents.

15. A process according to claim 1, wherein hot gas is injected at desired locations in the strata to form a peripheral boundary defining a working zone by creating substantially fluid impermeable barriers by melting and susequent re-solidifying of heavy hydrocarbons.

16. A process according to claim 15, wherein the hot gases include a mixture of gases available from wellhead separation and/or cracking plant, injected at a pressure higher than that of the mining liquids.

17. A process according to claim 15, wherein the hot gas injected is arranged to create a "cap" of gas under pressure over the working zone which promotes flow of mining liquids and liquid hydrocarbons toward the well bore at the collecting level.

18. A process for recovery of hydrocarbons from mineral oil deposits, comprising the steps of:

(a) establishing fluid communication between a deposit and a collecting facility remote from the deposit, (b) forming at least a first and a second substantially vertically spaced, planar fractures in a hydrocarbon bearing strata, (c) injecting a filling medium incorporating electrically conductive particles into the fractures where the fractures are propped open by the medium, (d) connecting a first electrode to the first fracture and a second electrode to the second fracture where said first and second electrodes are of opposite polarity, (e) passing electrical current between the first and second fractures to promote migration of dielectric materials in the strata, (f) establishing an injection point and a collection point in the strata where the points are located at the first and second fractures, (g) injecting mining liquids into the strata at the injection point to render flowable and displace hydrocarbons contained in the strata toward the collection point; and (h) collecting at the collecting point the flowable hydrocarbons.

19. A process according to claim 18 where the filling medium is fluid permeable.

20. A process according to claim 19 where the injection point is located at a lower level in the strata than the collection point.

21. A process according to claim 20 where the first fracture is horizontally disposed above and substantially parallel to the second fracture, and where the first fracture is connected to the negative electrode and the second fracture is connected to the positive electrode.

22. A process according to claim 18 further including the steps of continuous and hydrodynamic recycling the mining liquids by separating and regenerating from the hydrocarbons the liquids collected from the collecting point and reinjecting the mining liquids into the strata.

* * * * *